US009181774B2

(12) United States Patent
Khisamov et al.

(10) Patent No.: US 9,181,774 B2
(45) Date of Patent: Nov. 10, 2015

(54) METHOD AND DEVICE FOR ZONAL ISOLATION AND MANAGEMENT OF RECOVERY OF HORIZONTAL WELL DRAINED RESERVES

(71) Applicant: Otkrytoe aktsionernoe obschestvo "Tatneft" im. V. D. Shashina, Almetievsk (RU)

(72) Inventors: Rais Salikhovich Khisamov, Leninogorsk (RU); Iliyas Akhmatgalievich Nuriev, Almetievsk (RU); Gabdrashit Sultanovich Abdrakhmanov, Moscow (RU); Valery Askhatovich Iktisanov, Bugulma (RU); Ilshat Damirovich Vakhitov, Almetievsk (RU); Ilkham Gadnanovich Nizamov, Nab. Chelny (RU); Nigamatyan Khamitovich Khamitiyanov, Bugulma (RU); Arnold Gennadievich Korzhenevsky, Bugulma (RU); Sergei Leonidovich Bagnyuk, Bugulma (RU); Vitaly Petrovich Filippov, Bugulma (RU); Lyubov Mikhailovna Mironova, Bugulma (RU); Andrei Arnoldovich Korzhenevsky, Moscow (RU)

(73) Assignee: OTKRYTOE AKTSIONERNOE OBSCHESTVO "TATNEFT" IM. V.D.SHASHINA, Tatarstan, Almetievsk (RU)

( * ) Notice: Subject to any disclaimer, the term of this patent is extended or adjusted under 35 U.S.C. 154(b) by 365 days.

(21) Appl. No.: 13/732,507

(22) Filed: Jan. 2, 2013

(65) Prior Publication Data

US 2013/0186618 A1 Jul. 25, 2013

(30) Foreign Application Priority Data

Jan. 10, 2012 (RU) ..... 2012100083

(51) Int. Cl.
*E21B 43/14* (2006.01)
*E21B 33/13* (2006.01)
(Continued)

(52) U.S. Cl.
CPC ..... *E21B 33/13* (2013.01); *E21B 43/128* (2013.01); *E21B 43/14* (2013.01); *E21B 47/12* (2013.01)

(58) Field of Classification Search
CPC ..... E21B 43/12; E21B 43/126; E21B 43/14; E21B 33/122
See application file for complete search history.

(56) References Cited

U.S. PATENT DOCUMENTS 5,103,912 A * 4/1992 Flint ..... 166/297
5,117,906 A * 6/1992 Giusti et al. ..... 166/120
(Continued)

FOREIGN PATENT DOCUMENTS

RU 59 139 U1 12/2006
RU 2 313 659 C1 12/2007

OTHER PUBLICATIONS

Claims English translation of RU 59 139 U1 published Dec. 10, 2006.
(Continued)

*Primary Examiner* — Frederick L Lagman
(74) *Attorney, Agent, or Firm* — Ladas & Parry LLP

(57) ABSTRACT

The invention relates to the oil and gas production industry, in particular, to development and production of oil reservoirs with various permeability zones, specifically, with lateral/lateral horizontal holes, drilled from the production casing. The method described includes running into the well of a tubing string with a cable, control devices in form of electrical valves, measurement pressure and temperature sensors, and one or more packers for isolation of the downhole space, in which information from the sensors is passed to the measurement unit at the wellhead, and signals for opening/closing of the control devices are transferred from the wellhead control unit by the cable. A device for carrying out this method is also described.

5 Claims, 3 Drawing Sheets

(51) Int. Cl.
*E21B 43/12* (2006.01)
*E21B 47/12* (2012.01)

(56) References Cited

U.S. PATENT DOCUMENTS

| | | | | |
|---|---|---|---|---|
| 5,161,613 | A * | 11/1992 | Jones | 166/242.3 |
| 5,447,201 | A * | 9/1995 | Mohn | 166/375 |
| 6,227,298 | B1 * | 5/2001 | Patel | 166/321 |
| 2002/0096329 | A1 * | 7/2002 | Coon et al. | 166/278 |
| 2005/0263287 | A1 * | 12/2005 | Achee et al. | 166/313 |
| 2011/0186300 | A1 * | 8/2011 | Dykstra et al. | 166/316 |
| 2012/0018167 | A1 * | 1/2012 | Konopczynski et al. | 166/369 |
| 2012/0241168 | A1 * | 9/2012 | Pei et al. | 166/373 |
| 2013/0062072 | A1 * | 3/2013 | Alvarez et al. | 166/376 |
| 2013/0175033 | A1 * | 7/2013 | Baihly et al. | 166/284 |

OTHER PUBLICATIONS

Claims English translation of RU 2 313 659 C1 published Dec. 27, 2007.

* cited by examiner

METHOD AND DEVICE FOR ZONAL ISOLATION AND MANAGEMENT OF RECOVERY OF HORIZONTAL WELL DRAINED RESERVES

The invention relates to the oil and gas production industry, in particular, to development and production of oil reservoirs with various permeability zones, specifically, with lateral holes and lateral horizontal holes, drilled from the production casing.

From the previous art it is known the "Downhole dual-completion system for operation of Several Production Zones" (RU 59139, U1), comprising a tubing string, forming stages with one or more packers and one or more adjustable choking device; besides, every stage of the system has adjustable choking devices with automatic remote control and control and measurement instruments with automatic remote control; furthermore, every stage of the facility is provided with, at least, one electroconductive cable, upper end of which is connected to the remote control unit at the ground surface, and the lower end is connected to the above-mentioned choking devices and control measurement instruments, and the packers are equipped with a connector and/or a sealing device for the cable.

This device is a means of realization of a dual completion method for production from multi-zone wells, including running-in of a tubing string with one ore more packers to isolate the formations, adjustable chocking devices to control the production flow rate, and the control and measurement devices with automatic remote control from the surface through the electroconductive cable, in which production is conducted in accordance with operational parameters of every zone, determined with the control and measurement devices, by way of changing passage area of the chocking devices.

This prior art device and the method of its application have the following disadvantages:

- complexity of application in horizontal wellbore due to the fact installation of adjustable chocking and control and measurement devices, as well as an electroconductive cable is impeded by the small dimensions of the borehole, and, frequently, by its configuration complexity;
- high material and time costs for installation of equipment in the well, since the adjustable chocking devices and control-and-measurement devices are to be installed against each zone, both oil-saturated, and poorly oil saturated.

The closest to the present invention by its technical essence is a "Method of multi-zone wells operation using dual completion systems" (RU 2313659 C1), consisting in running-in of at least one tubing string of a permanent or variable diameter with open/plugged-up lower end, provided with one or more packers, installed between the formations or between/above the formations, to isolate the formations, and with a control device to control the production flow rate, besides, the tubing string or the control device at the pay interval are equipped with a measuring transducer to transfer the obtained measurement data to the wellhead and to determine the production performance, which is achieved by running-in a cable or a control line inside/outside the casing, and connect it to the measuring transducer or the device control device, or both of them (of removable type); further, after installing wellhead equipment, the fluid is produced, being passed through the device control device and the measuring transducer, and the measurement information from the measuring transducer is obtained at the wellhead, and fluid technological parameters during production are determined; in case said parameters differ from the design values, the passage area of the control device is changed until fluid production for each zone will be obtained. Moreover, a measuring transducer is provided with an interface to save the measured operational parameters data. Furthermore, the measuring transducer is made in form of a pressure/differential pressure gage, temperature/temperature gradient sensor, a flowmeter, or displacement/mass flowmeter. Besides, the control device is made in form of electric, electromagnetic or a pulse valve with a gate, degree of opening of which is controlled from the wellhead by way of sending a signal or an impulse via the cable or a control line.

To implement the method, a device is used, comprising a tubing string with one or more packers and one or more control devices, in which the tubing string or the control device is provided with a measuring transducer with an interface, and a cable or a control line.

The disadvantages of said device and its realization method are:

- complexity of application in horizontal wellbore because installation of adjustable control devices and measuring transducers, as well as cables/control lines is impeded by small dimensions of the borehole, and, in case of wireline technique, is just impossible;
- high material costs and time spending for installation of equipment in the well, since the adjustable control devices and measuring transducers are installed in each zone, both oil-saturated, and poorly oil-saturated.

The technical objects of the invention: expanding the technological capabilities of the devices in wells with various permeability zones, including wells with lateral horizontal holes, due to production from the wells with low-permeable and medium-to-high-permeable intervals by two channels with controlled from the surface production regime for each type of isolated from each other zone; and, reduction of equipment installation costs due to usage of control devices, measuring transducers and a cable in the vertical wellbore.

Said technical object is attained by he method, including running into the well of a tubing string with a cable, control devices in form of electrical valves, measuring pressure and temperature sensors, and one or more packers for isolation of the downhole space, in which information from the sensors is passed to the measurement unit on the wellhead, and signals for opening/closing of the control devices are transferred from the wellhead control unit by the cable; delivery of the wellstream to the surface is performed with a pump through the tubing interior.

The novelty of the invention consists in the fact a well is constructed with a horizontal section, penetrating various permeability zones of the formation, and the packers are installed in the horizontal section of the well to isolate these zones of various permeability, the tubing interior is isolated by a plug, above which the upper and lower control devices are located one above the other in a vertical hole, provided with measurement sensors; further, zones of the same/approximately the same permeability are connected to form two streams communicated with downhole space and inlet of the upper control device or tubing interior and inlet of the lower control device; outlets of the control devices are connected to the pump inlet, and degree of opening of the control devices is controlled by the same cable with frequency separation, by which data from the measurement sensors are also transferred, and opening degree of each control device is determined by these data.

Technical problem for implementation of the method is solved also with the device, comprising a tubing string with a cable, control devices in form of electric valves, measurement pressure and temperature sensors, and one or more packers, shutting-off the downhole space; besides, the sensors are connected with a wellhead measurement unit, and the control devices are connected by the cable with a control unit; moreover, a pump for delivering the wellstream up to the surface through the tubing interior is installed above said control devices.

What is new is that a well is provided with a horizontal section, passing through the reservoir with various permeability zones, and the packers are installed in the horizontal section, separating said various permeability zones; tubing interior is isolated with a plug, above which the upper and lower control devices are installed one above the other, located in a vertical hole and equipped with measurement sensors; inlet of the lower control device communicates with the tubing interior below the plug, and its outlet communicates with the tubing interior above the plug; inlet of the upper control device communicated with the downhole space, and its outlet communicates with the tubing interior above the plug, to which also the pump inlet is connected; the packer-isolated downhole spaces of the same or almost the same permeability are broken in two groups, each of which is connected to the tubing interior or the downhole space by means of one or several conduits; the sensors and the control devices are connected with the same cable to the measurement unit and to the control unit, correspondingly; besides, each control device is located in a housing of a gearmotor, the rotating shaft of which is connected by means of a screw-nut connection, with a tappet and a valve, made to provide hermetically sealed contact with a valve seat, below which a sleeve is installed with the inlet made in form of channels, in which a compensation chamber with flexible walls is located; the chamber is filled with lubricating fluid and communicates with internal space of the tappet and sealed space above the tappet.

Figure 4:
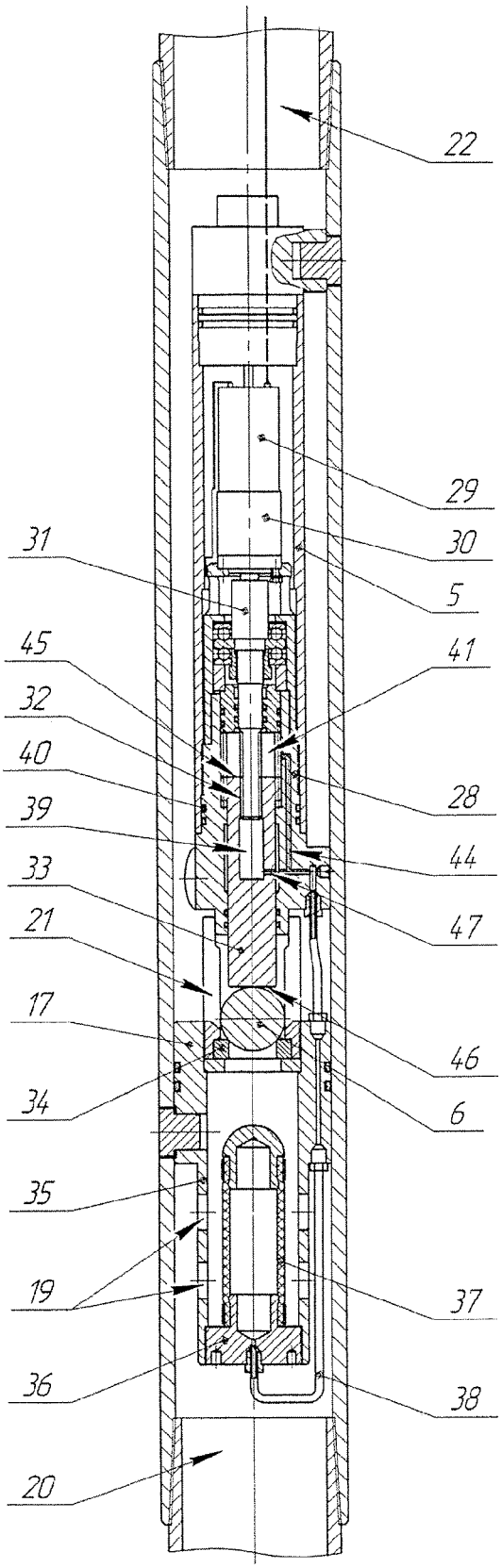

FIG. 4 presents the lower control device (longitudinal section).

The device for zonal isolation and management of reserves drainage through a horizontal well 1 (FIG. 1) comprises a tubing string 2 with a cable 3, upper 4 and lower 5 control devices in form of electric valves 6, installed in control devices 4, 5 measurement sensors of pressure 7 and temperature 8, and one or more packers 9, isolating the interior space 10 of the well 1. The sensors 7, 8 are connected by a cable 3 with a measurement unit 11 at the wellhead 12 of the well 1, and the control devices 4, 5 are connected by the same cable 3 with a control unit 13 by the control devices 4, 5. A pump 14 is installed above the control devices 4, 5 in order to deliver wellstream) up to the surface through the tubing interior 15.

Horizontal section of the well 1 passes through the formation 16 with various permeability zones A and B; in accordance with geophysical survey data, the formation 16 is isolated with the packers 9 into the intervals of low permeability A and of medium/high permeability B. Moreover, the tubing interior 15 is isolated by a plug 17, above which, one above the other, upper 4 and lower 5 control devices are located; said devices are installed in the vertical section 18 of the well 1 and provided with measurement sensors 7, 8.

Figure 1:
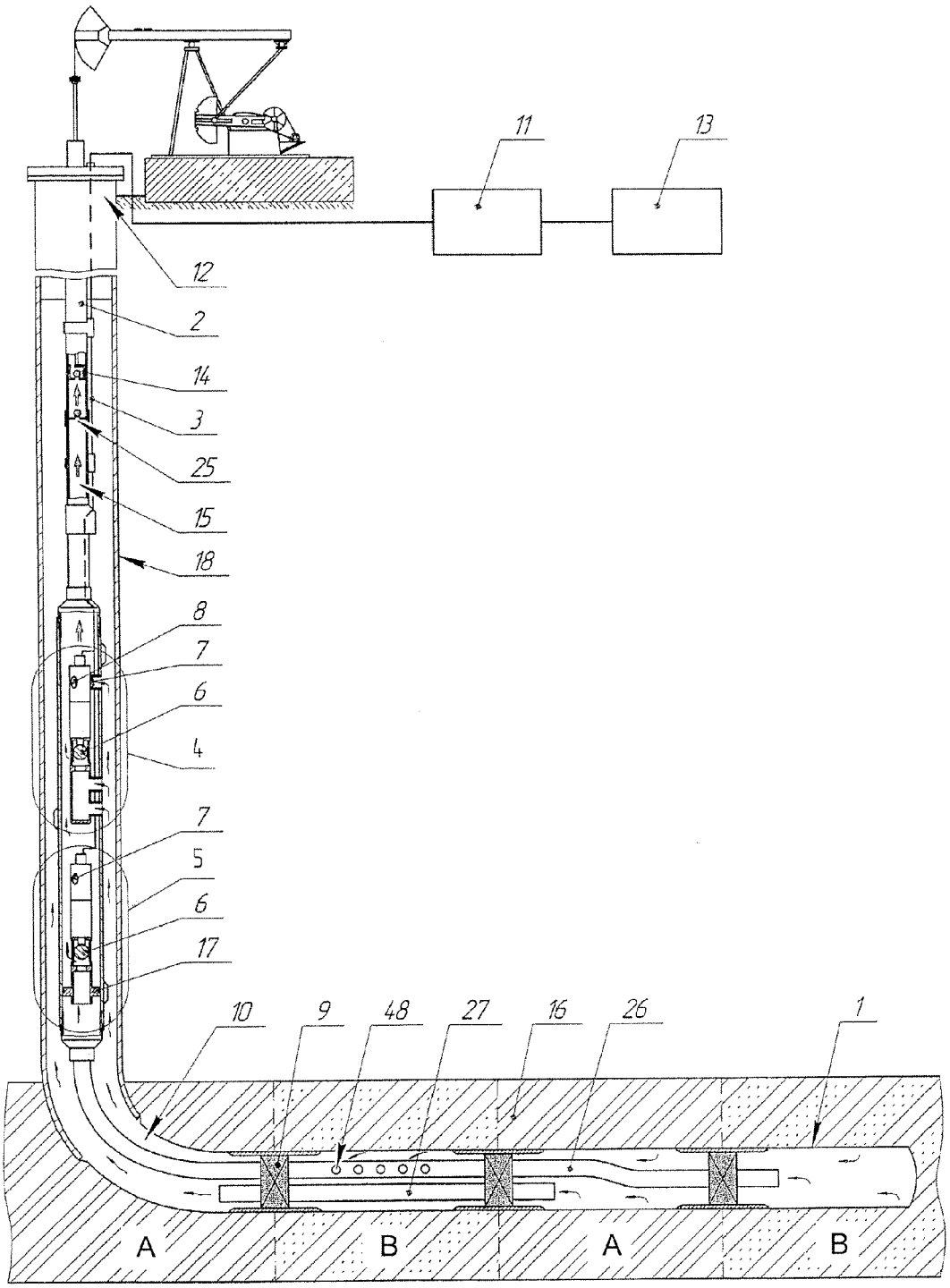
FIG. 1 shows overall view of the device.
Figure 2:
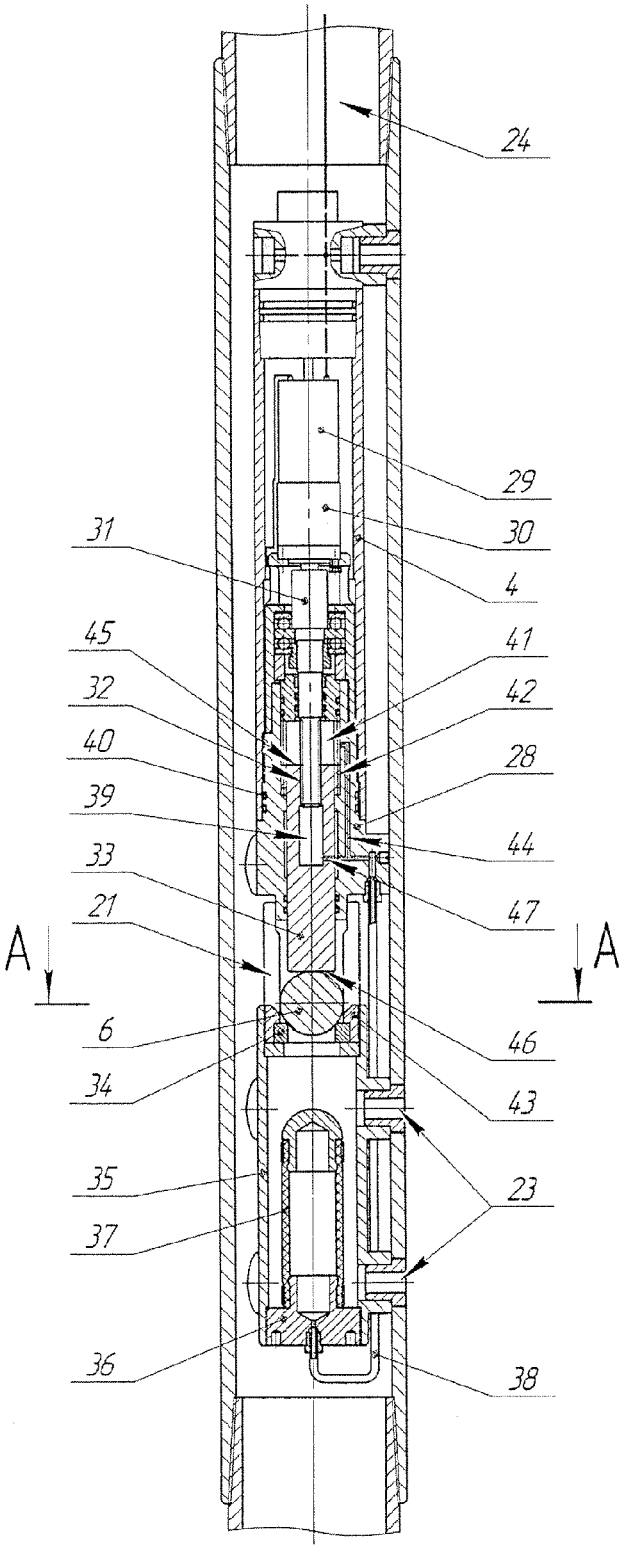
FIG. 2 shows the upper control device (longitudinal section)

Inlet ports 19 (FIG. 4) of the lower control device 5 communicate with the tubing space 20 below the plug 17, and outlet ports 21 communicate with the tubing space 22 above the plug 17. Inlet ports 23 (FIG. 2) of the upper control device 4 communicate with the downhole space 10 (FIG. 1), and the outlet 24 (FIG. 2) communicates with the tubing interior 15 (FIG. 1) above the plug 17 (FIGS. 1, 4), with which the pump 14 inlet 25 communicates (FIG. 1). Herewith, intervals A and B, separated by the packers 9 in the horizontal section of the well 1, are combined by the conduits 26, 27, coming through the packers 9, in two streams, each of which is connected to tubing interior 15, or to the downhole space 10. For example, intervals A are combined with each other and with the downhole space 10 by means of conduit 27, and intervals B are combined with each other and connected to the tubing interior 15 by means of conduit 26.

Besides, each control device 4 or 5 is made as an electric motor 29 with a gearbox 30 positioned in the housing 28 (FIG. 2, 4), the rotating shaft 31 of which is connected by means of a screw-nut connection 32, with a tappet 33 and a valve 6, made to provide hermetically sealed contact with a valve seat 34. Below the seat 34 a sleeve 35 is installed with the inlets in form of inlet ports 23 (FIG. 2) or 19 (FIG. 4), in which a compensation chamber 36 (FIG. 2, 4) is positioned with flexible walls, for instance, as a rubber pipe 37, filled with a lubricating fluid and connected by a hollow pipe 38 with internal space 39 of the tappet 33, and a sealed (for instance, with O-rings 40) space 41, located above the tappet 33.

The above-mentioned method is realized in the following way:

A horizontal well 1 is drilled in the formation 16 (FIG. 1). After conducting geophysical surveys and determining the number and lengths of oil production intervals (of low permeability A and medium/high permeability B), on the tubing string 2 the packers 9 are run-in into the horizontal section of the well 1; the packers 9 are installed such that to isolate from each other the intervals A and B of downhole space 10; the said packers 9 have the conduits 26, 27, connecting with each other the intervals of the same permeability to oil; further, in the vertical section 18 of the well 1 the upper 4 and lower 5 control devices are positioned one above the other, in form of electric valves 6 with measurement pressure sensors 7 and temperature sensors 8; also, here the electric cable 3 is positioned. Therewith, the valves 6 of the control devices 4, 5 are half-open to provide for a better inflow of fluid from the well 1 into the tubing interior 15.

On the basis of the data, transmitted by the sensors 7, 8 to the measurement unit 11 at the wellhead 12 of the well 1, they determine corresponding pressure and temperature of each oil production stream. Depending on the data, received from the wellhead control unit 13, the signals of the corresponding frequency are sent through the cable 3 for opening/closing of the corresponding control device 4 or 5. Delivery of the well 1 fluid up the wellhead 12 is performed by the pump 14 by the tubing interior 15.

Figure 3:
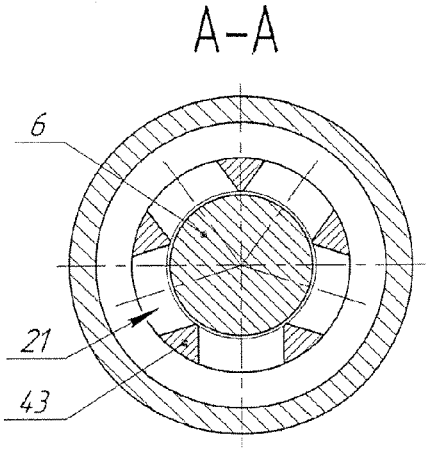
FIG. 3 shows enlarged view of A-A section on FIG. 2.

Monitoring of the data, obtained by the sensors 7, 8, is carried out permanently. If necessary, the passage area of the valves 6 of the control devices 4 is changed. For example, to increase oil production rate of the intervals A of the well 1, it is necessary to open the valve 6 of the upper control device 4. For this purpose, a signal is sent from the control unit 13 at the wellhead 12 of the well 1 through the cable 3 to the control device 4. Upon this, the electric motor 29 (FIG. 2), located in the housing 28 of the device 4, through the gearbox 30 starts to rotate in required direction the shaft 31, which, in turn, due to the screw-nut connection 32, displaces the tappet 33 along the spline joint 42 away from the valve 6. Under action of the borehole pressure, the valve (FIGS. 2, 3) deviates from the seat 34 (FIG. 2) along the guide 43, increasing its passage area. The fluid, produced from the intervals A, partially passes through the conduit 27 (FIG. 1), and is partially produced from the region in front of the conduit 27, and, moving along the downhole space 10, through the inlet ports 23 (FIG. 2) enters the sleeve 35, then through the seat 34 of the valve 6 and outlet ports 21 (FIG. 2, 3) of the guide 43, and by the outlet port 24 comes up by the tubing interior 15 (FIG. 1) to the inlet 25 of the pump 14.

To avoid borehole pressure loading on screw-nut connection 32 (FIG. 2, 4) a compensation chamber 36 is provided in the sleeve 35 from the side of the valve 6 and the tappet 33, rubber pipe 37 of which is compressed by the action of the borehole pressure, transferring this pressure through the lubricating fluid in the pipe 37 along the pipe 38 and a channel 44 to the internal space 41 above the tappet 33. Since cross-section area of the top portion 45 of the tappet 33 equals to or is a little less than a cross-section area of the bottom portion 46 of the tappet 33 (or the seat 34 of the valve 6, if the valve 6 is completely closed), the pressures under the tappet 33 and above it balance (or nearly balance) each other, removing the load on the connection 32, caused by the borehole pressure, and, thus, increasing service life of the connection 32, as well as a rotating shaft 31, electric motor 29, and gearbox 30. At the same time, the lubricating fluid lubricates the screw-nut connection 32 and the spline joint 42. The channel 47 ensures backflow of the lubricating fluid from the internal space 39 in case of the tappet 33 movement.

The lower control device 5 (FIGS. 1, 4) is operated in accordance with the same principle. To avoid inadvertent production of fluid from the well 1 (FIG. 1), bypassing the devices 4, 5, a plug 17 is set below them in the tubing interior 15. Production fluid from B intervals in this case combines in a single stream in the conduit 26 and flows through the tubing interior 20 (FIG. 4) and inlet ports 19 below the plug 17 of the valve 6 of the device 5, and further, (when the valve 6 is open) through the outlet channels 21 and tubing interior 22 above the plug 17 to the tubing interior 15 (FIG. 1). In particular case, the conduit 26 can be perforated with the holes 48.

Thus, application of the invention makes it possible to expand operational capabilities of production from horizontal wells, simultaneously including low-permeable and medium/high-permeable intervals of various geophysical properties, separated by packers, via two independent streams by means of conduits, connecting them and coming through the packers, with surface controlled regime of production from each separated zone. Moreover, location of the control devices, measurement sensors and a cable in the vertical section of the well provides for reduction of the equipment installation costs and improvement of quality and reliability of the installation.

The invention claimed is:

1. A method for zonal isolation and management of recovery of reserves from a horizontal well comprising a wellhead, a vertical section and a horizontal section, the horizontal section passing through a formation with a multiplicity of permeability zones, including a plurality of separated first zones each having approximately the same permeability as each other and a plurality of separated second zones each having approximately the same permeability as each other and a different permeability than each of the plurality of first zones, the method comprising running into the well a tubing string with a cable, first and second control devices comprising respective valves and a plurality of measurement sensors, a pump, a plurality of packers and a plurality of conduits such that:

(a) the plurality of packers are disposed in the horizontal section separating the multiplicity of permeability zones from each other with each of the plurality of separated first zones connected to each other with a first of the plurality of conduits for delivery of a first stream comprising reserves from each of the plurality of first zones, and with each of the plurality of separated second zones connected to each other with a second of the plurality of conduits for delivery of a second stream comprising reserves from each of the plurality of second zones;

(b) the first and second control devices are positioned in the vertical section of the well one above the other with an inlet of the first control device in fluid communication with the first stream and an inlet of the second control device in fluid communication with the second stream and with respective outlets of the first and second control devices operationally connected to an inlet of the pump such that the pump can pump to the wellhead either reserves from the first stream through the first control device or reserves from the second stream through the second control device; and (c) the measurement sensors can transmit data to the wellhead and the cable can transmit signals from the wellhead to the respective first and second control devices to control opening and closing of the respective valves of the first and second control devices whereby to control whether reserves from the first or second stream are pumped to the wellhead based upon data transmitted from the measurement sensors.

2. The method according to claim 1 comprising pumping reserves from the first stream based on data transmitted from the measurement sensors.

3. The method according to claim 1 comprising pumping reserves from the second stream based on data transmitted from the measurement sensors.

4. An apparatus for zonal isolation and management of reserves drainage through a well comprising a first, vertical section disposed vertically with respect to a surface of the earth and a second, horizontal section disposed horizontally to the surface and passing through a formation having a plurality of permeability zones with separated first and third portions of the horizontal section being disposed in respective first permeability zones having the same or approximately the same permeability as each other and separated second and fourth portions of the horizontal section being disposed in respective second permeability zones having the same or approximately the same permeability as each other but having a different permeability than the first permeability zones, the apparatus comprising:

(a) a plurality of packers separating the first, second, third and fourth portions of the horizontal section;

(b) a plurality of conduits passing through the packers, including a first conduit connecting the separated first and third portions for delivery of a first stream of reserves from the first permeability zones to a first tubing space in the well, and a second conduit connecting the separated second and fourth portions for delivery of a second stream of reserves from the plurality of second zones to a downhole space in the well;

(c) a plug separating the first tubing space from a second tubing space disposed in the vertical section of the well;

(d) first and second control devices comprising respective measurement sensors and valves, the first and second control devices being disposed one above the other in the vertical section of the well above the plug with the first control unit comprising an inlet in fluid communication with the first tubing space below the plug and an outlet in fluid communication with the second tubing space above the plug and with the second control unit comprising an inlet in fluid communication with the downhole space below the plug and an outlet in fluid communication with a tubing interior above the plug;

(e) a pump constructed and arranged in the vertical section for pumping either the first stream or the second stream to the surface; and (f) a wellhead comprising a measurement unit connected to the sensors and a control unit connected by a cable to each of the first and second control devices and configured for controlling opening and closing of the respective valves of the first and second control devices.

5. The apparatus according to claim 4, wherein each of the first and second control devices comprises a housing, an electric motor, a gearbox in the housing, a rotating shaft connected with a tappet and a respective one of the valves, a valve seat for the valve, a sleeve comprising a respective one of the inlets, the inlet being in the form of a channel comprising a compensation chamber with flexible walls, the chamber being filled with lubricating fluid and communicating with an internal space of the tappet and a sealed space above the tappet.

* * * * *